US008695907B2

(12) United States Patent
Reznitchenko et al.

(10) Patent No.: US 8,695,907 B2
(45) Date of Patent: Apr. 15, 2014

(54) ROLLER CRUSHER WITH CHEEK PLATES

(75) Inventors: Vadim Reznitchenko, Mechanicsburg, PA (US); Keith Harbold, York, PA (US)

(73) Assignee: Metso Minerals Industries, Inc., Waukesha, WI (US)

( * ) Notice: Subject to any disclaimer, the term of this patent is extended or adjusted under 35 U.S.C. 154(b) by 68 days.

(21) Appl. No.: 13/451,915

(22) Filed: Apr. 20, 2012

(65) Prior Publication Data

US 2013/0277479 A1 Oct. 24, 2013

(51) Int. Cl.
*B02C 23/00* (2006.01)

(52) U.S. Cl.
USPC ..... 241/226; 24/285.3; 24/234

(58) Field of Classification Search
USPC ..... 241/226, 230, 232–234, 285.1, 285.3, 241/292
See application file for complete search history.

(56) References Cited

U.S. PATENT DOCUMENTS

| | | | | | |
|---|---|---|---|---|---|
| 340,720 | A | * | 4/1886 | Krom | 241/232 |
| 667,777 | A | * | 2/1901 | Iler | 241/232 |
| 727,177 | A | * | 5/1903 | Montgomery | 241/232 |
| 3,899,965 | A | * | 8/1975 | Koch et al. | 100/155 R |
| 3,970,256 | A | * | 7/1976 | Ruegger et al. | 241/231 |
| 4,168,806 | A | * | 9/1979 | Jakobs | 241/232 |
| 4,838,494 | A | | 6/1989 | Jakobs | |
| 5,199,657 | A | | 4/1993 | Kastingschafer et al. | |
| 5,263,651 | A | | 11/1993 | Nadaraja | |
| 5,372,315 | A | * | 12/1994 | Kranz et al. | 241/30 |
| 5,417,374 | A | | 5/1995 | Kranz et al. | |
| 5,553,796 | A | | 9/1996 | Bettenworth | |
| 5,568,896 | A | | 10/1996 | Adams et al. | |
| 5,865,382 | A | | 2/1999 | Bielagus | |
| 8,297,847 | B2 | * | 10/2012 | Niklewski et al. | 384/432 |
| 2005/0199757 | A1 | | 9/2005 | Sano | |
| 2010/0310702 | A1 | | 12/2010 | Splinter | |
| 2011/0114772 | A1 | | 5/2011 | Nickel | |

FOREIGN PATENT DOCUMENTS

| | | | |
|---|---|---|---|
| AT | 347 212 | | 12/1978 |
| DE | 38 25 716 | A1 | 2/1990 |
| WO | 98/08608 | A1 | 3/1998 |
| WO | 2011/051117 | A1 | 5/2011 |
| WO | 2011/131428 | A1 | 10/2011 |

OTHER PUBLICATIONS

Machine translation for foreign reference AT 347212, listed in IDS (Jul. 16, 2012).*
Machine translation for foreign reference DE 38 25 716, listed in IDS (May 17, 2013).*
European Search Report dated Apr. 22, 2013.

* cited by examiner

*Primary Examiner* — Faye Francis
*Assistant Examiner* — Leonel Vasquez
(74) *Attorney, Agent, or Firm* — Andrus Intellectual Property Law, LLP

(57) ABSTRACT

The present invention relates to a roller crusher having a base frame and a roller frame movably connected to the base frame. Two generally parallel rotatable rollers separated from each other by a gap are arranged in the roller frame. The roller crusher further includes a feeding arrangement mounted to the base frame for feeding material to the rollers and at least one balancing cylinder is provided which are connected to and arranged to manipulate the roller frame relative to the base frame such that the position of the rollers relative to the feeding arrangement can be adjusted. Front and rear cheek plates are provided at the roller frame partially covering front and rear end surfaces of one of the rollers and at least partially covering an opening between the feeding arrangement and the two rollers, the cheek plates being fixedly mounted to the roller frame.

19 Claims, 4 Drawing Sheets

ROLLER CRUSHER WITH CHEEK PLATES

FIELD OF THE INVENTION

The present invention relates to crushing device, especially a roller crusher where two, generally parallel rollers are separated by a gap and rotate in opposite directions, towards each other.

BACKGROUND OF THE INVENTION

When crushing or grinding rock, ore, cement clinker and other hard materials, roller crushers may be used having two generally parallel rollers which rotate in opposite directions, towards each other, and which are separated by a gap. The material to be crushed is fed by gravity or choke-fed into the gap. One type of roller crusher is called high pressure grinding rollers or high pressure roller crushers. This type of roller crusher uses a crushing technique called interparticle crushing. Here, the material to be crushed or pulverised is crushed, not only by the crushing surface of the rolls, but also by particles in the material to be crushed, hence the name interparticle crushing. One example of a high pressure grinding roller is described in EP-2214898. where the gap width between the two rollers can be adjusted as well as the position of the rollers within the frame. The solution disclosed in that prior art is, however, complicated.

SUMMARY OF THE INVENTION

It is an object of the invention to provide a roller crusher which overcomes, or at least reduces, the above mentioned problems, and ensures a simple yet reliable sealing of the gaps occurring at a front side and a rear side of the roller crusher between the rollers and a feeding arrangement. This object and other objects are achieved by a roller crusher according to the present invention.

Thus, in accordance with an aspect of the present invention, there is provided a roller crusher having a base frame and a roller frame movably connected to said base frame. Two generally parallel rotatable rollers separated from each other by a gap are arranged in said roller frame and a feeding arrangement is mounted to the base frame for feeding material to said rollers. At least one balancing cylinder is provided which is connected to and arranged to manipulate said moveable roller frame relative to said base frame such that the position of the rollers relative to said feeding arrangement can be adjusted. Further, front and rear cheek plates are provided at the roller frame which partially cover front and rear end surfaces of one of the rollers and at least partially cover an opening between the feeding arrangement and the two rollers. The reason for providing cheek plates is that they cover the gaps occurring on the front and rear side of the roller crusher between the rollers and the feeding arrangement such that grinding material cannot escape. When the at least one balancing cylinder is activated, the roller frame moves relative to the base frame thus changing the position of the rollers and the gap between said rollers relative to the feeding arrangement. Since the cheek plates are fixedly mounted to the roller frame they, will follow the roller during adjustment of the position thereof, thus providing good sealing properties also during and after position adjustments.

In accordance with an embodiment of the roller crusher, the roller frame comprises a first and a second roller frame section, each roller frame section being pivotably connected with the base frame and arranged to carry one of said rollers in bearings arranged at opposed ends of said each roller. By providing two separate roller frame sections, each carrying one of the rollers it is possible to achieve gap width adjustment by simply displacing the roller frame sections relative to each other until a preferred gap width has been attained.

In accordance with an embodiment of the roller crusher, each roller frame section comprises a front and a rear roller plate, said front and rear roller plates being interconnected by means of a spacer pipe extending substantially parallel with the rollers.

In accordance with an embodiment of the roller crusher, the bearings carrying each roller are mounted in a front bearing cap comprised in the front roller plate and a rear bearing cap comprised in the rear roller plate.

In accordance with an embodiment of the roller crusher, a front cheek plate is fixedly mounted to a front bearing cap of the first roller frame section and the rear cheek plate fixedly mounted to a rear bearing cap of said first roller frame section. The cheek plates are arranged to seal against the feeding arrangement and against short sides of the roller carried by said first roller frame section. The cheek plates cover the open area below the feeding arrangement to avoid that material fills the gap. By mounting the cheek plate to the bearing cap, it is achieved that it follows the roller frame section as it moves during gap adjustments and similar.

In accordance with an embodiment of the roller crusher, the front and the rear cheek plates are fixedly mounted to said spacer pipe.

In accordance with an embodiment of the roller crusher, the feeding arrangement comprises a front and a rear side plate, wherein a lower surface of the side plate and an upper surface of an adjacent cheek plate have corresponding shapes. This provides for excellent sealing properties since material cannot escape between the side plate and the cheek plate.

In accordance with an embodiment of the roller crusher, the corresponding shapes of the lower surface of the side plate and the upper surface of an adjacent cheek plate are arranged such that, during adjustment of the position of the rollers, the upper surface of the cheek plate follows the lower surface of the adjacent side plate. This safeguards reliable sealing properties at all working situations of the roller crusher.

In accordance with an embodiment of the roller crusher, a distance between the upper surface of the side plate and the lower surface of the cheek plate is approximately 10 mm.

In accordance with an embodiment of the roller crusher, a bracket is welded to the front and the rear bearing cap respectively and the front and the rear cheek plates are bolted to a respective bracket. By welding and bracket to the roller frame and subsequently bolting the cheek plate to the bracket, it is achieved that the cheek plates in an convenient manner may be replaced when worn out.

In accordance with an embodiment of the roller crusher, brackets are welded to the spacer pipe and the front and the rear cheek plates are bolted to a respective bracket.

In accordance with an embodiment of the roller crusher, two gap adjusting cylinders are provided. One gap adjusting cylinder interconnects the respective front roller plates of the first and second roller frame sections and another gap adjusting cylinder interconnects the respective rear roller plates of the first and second roller frame sections and wherein the gap adjusting cylinders are individually adjustable. This makes it possible to adjust a skew between the rollers. Adjusting the two gap adjusting cylinders individually enables compensation for uneven feeding of e.g. ore material along the length of the rollers or other situations that may arise during use. It would for example be possible to monitor the distance between the bearing housings of the rollers and when a preset maximum difference between the distances between the front bearing housings and the rear bearing housings respectively is exceeded, one cylinder may be locked and the other cylinder will be adjusted as necessary. Of course, it is possible to activate the gap adjusting cylinders in parallel, i.e. simultaneous adjustment.

In accordance with an embodiment of the roller crusher, two balancing cylinders are arranged to extend between the first roller frame and the base frame. By providing two adjustment cylinders, torsional moments occurring during use of the roller crusher can be carried in a appropriate manner.

In accordance with an embodiment of the roller crusher, a Programmable Logic Controller (PLC) is arranged to monitor and adjust operating conditions of the roller crusher.

In accordance with an embodiment of the roller crusher, the PLC is arranged to monitor the position of the centre of the gap between the rollers relative to a feed chute of the feeding arrangement and to adjust said position by activating at least one balancing cylinder in case of deviations of said position outside pre-set limits. The PLC can constantly monitor the gap and keep it within a predetermined range.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise. The steps of any method disclosed herein do not have to be performed in the exact order disclosed, unless explicitly stated. As used herein, the term "comprising" and variations of that term are not intended to exclude other additives, components, integers or steps.

DESCRIPTION OF PREFERRED EMBODIMENTS

Figure 1:
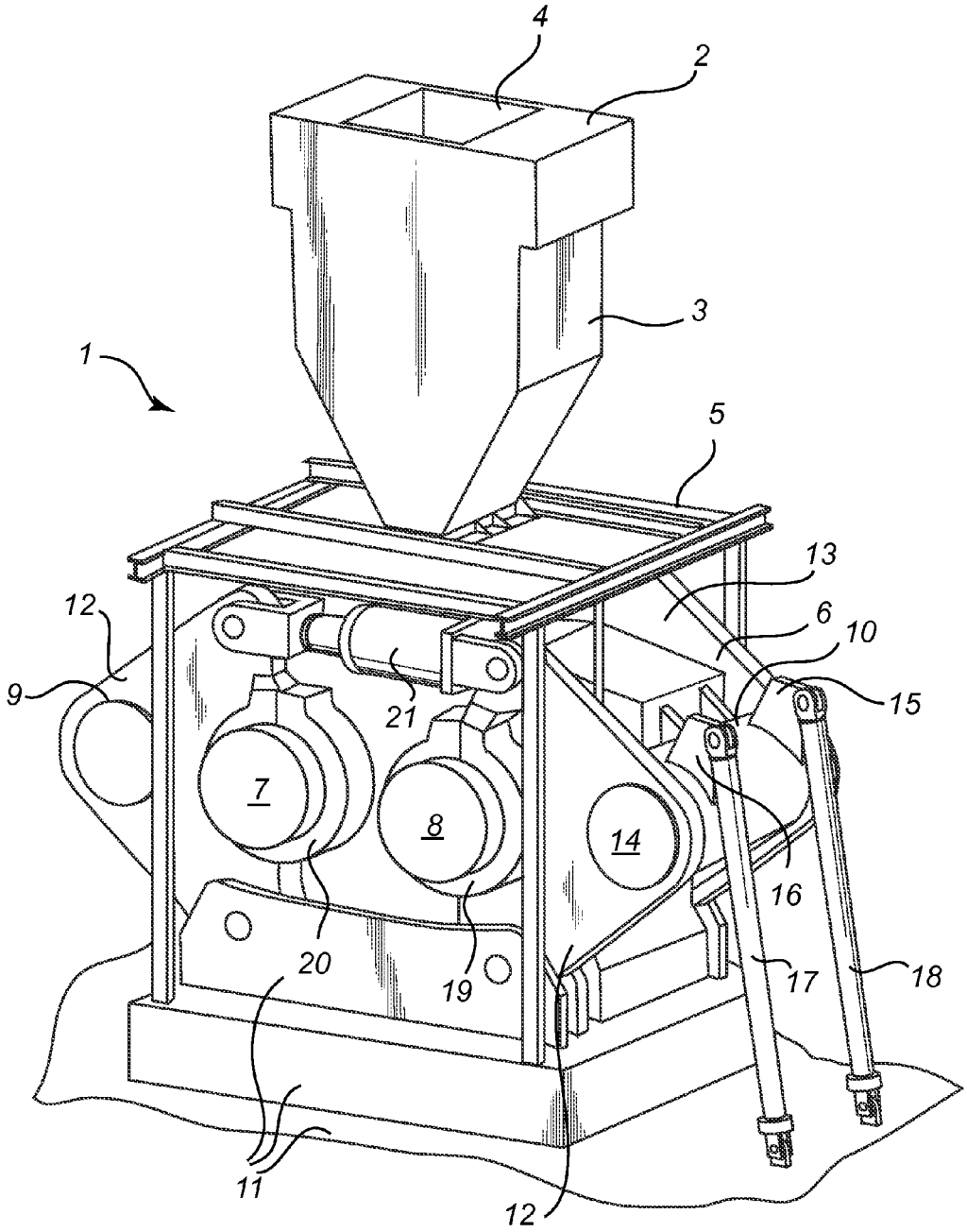
FIG. 1 shows a schematic perspective view of an embodiment of the invention.

In an embodiment of a roller crusher of the invention, as shown in the figures, the roller crusher 1 comprises a feeding arrangement 2 comprising a feeder hopper 3 having an upwardly directed opening 4 into which material such as rock, ore, cement clinker or other crushable material can be supplied. The feeding arrangement 2 is fixedly mounted to beam construction 5 which in turn is fixedly mounted in relation to the base frame 11. The base frame may be made in one piece, or in two or more pieces, fixed in relation to each other by attachment to a foundation. The roller crusher further comprises a roller frame 6 in which the rollers 7, 8 are carried in bearings (not shown in the figures). The roller frame 6 comprises two roller frame sections 9, 10 each of which is pivotally mounted to base frame 11 and comprises a front and a rear roller plate 12, 13 and a spacer pipe 14 extending generally parallel to the rollers 7, 8 and connecting the roller plates 12, 13. The roller frame sections 9, 10 further comprises fastening hooks 15, 16 to which two balancing cylinders 17, 18 are attached with their upper ends. The lower ends of said balancing cylinders are attached to base frame 11. Alternatively, the lower ends of the balancing cylinders may be attached to the foundation. The bearings for the rollers 7, 8 are mounted in bearing caps 19, 20 provided in both the front and rear roller plates 12, 13. Even though only the bearing caps 19, 20 of the front roller plates 12 are shown in the figures, the skilled person easily understands that the rear roller plates 13 are provided with corresponding bearing caps. Gap adjustment cylinders 21 are attached to upper regions of the front roller plates 12 and correspondingly to the rear roller plates 13, only the front gap adjustment cylinder can be seen in the figures.

Figure 2:
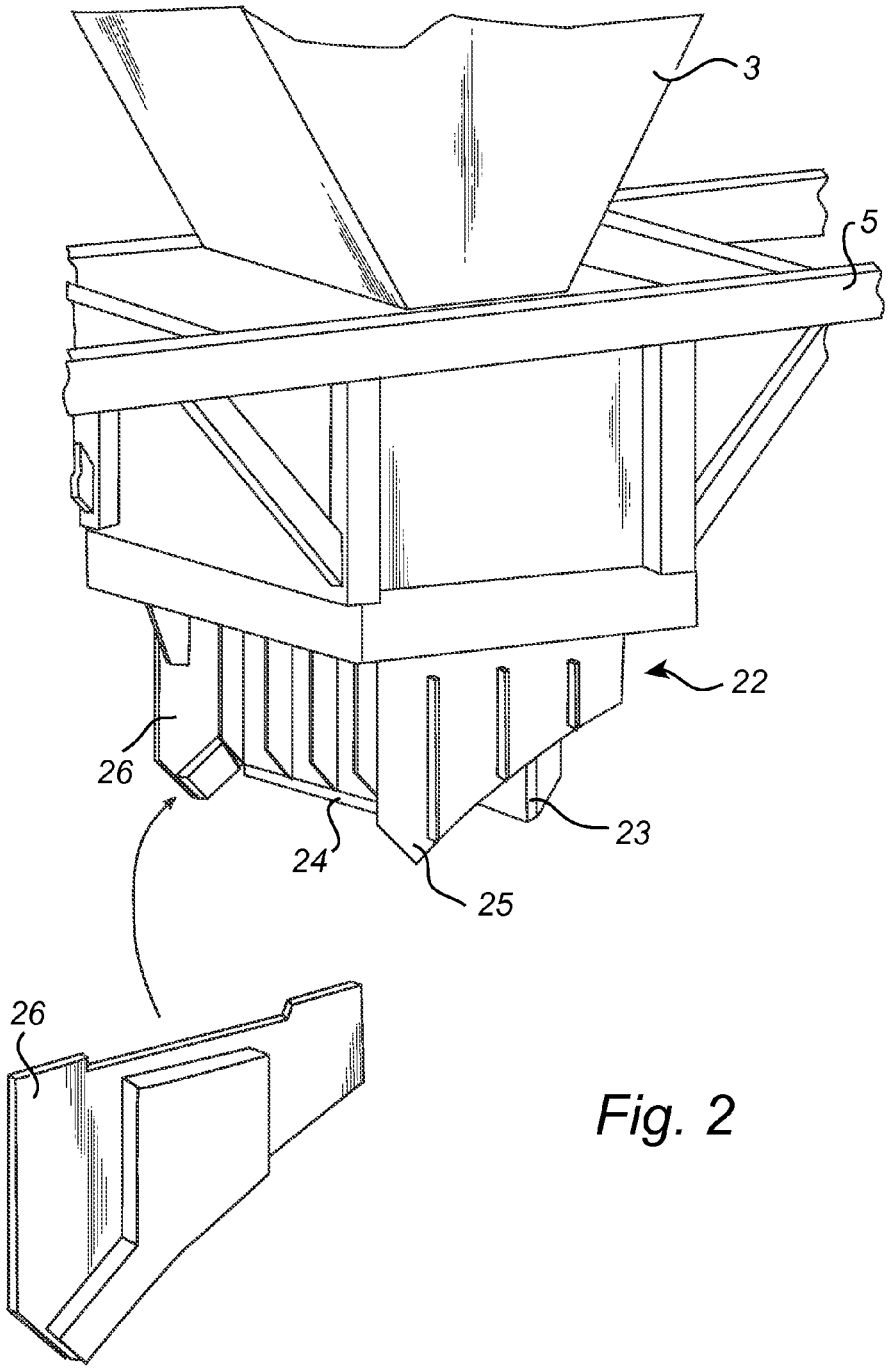
FIG. 2 shows a schematic perspective view of a feeding arrangement of an embodiment of the invention.

FIG. 2 shows details of the lower regions of the feeding arrangement 2 of the roller crusher 1 according to the invention. The feeder hopper 3 is provided with a feeding chute 22 directing the material to be crushed towards the rollers 7, 8. At the very bottom of the feed chute 22, guiding plates 23, 24 are provided which guides the flow of material towards the rollers. Side plates 25, 26 are attached to the feed chute by means of e.g. bolting or welding. The purpose of the side plates 25, 26 is to seal the gap between the guiding plates and to provide a sealing surface towards the cheek plates which will be described below.

Figure 3:
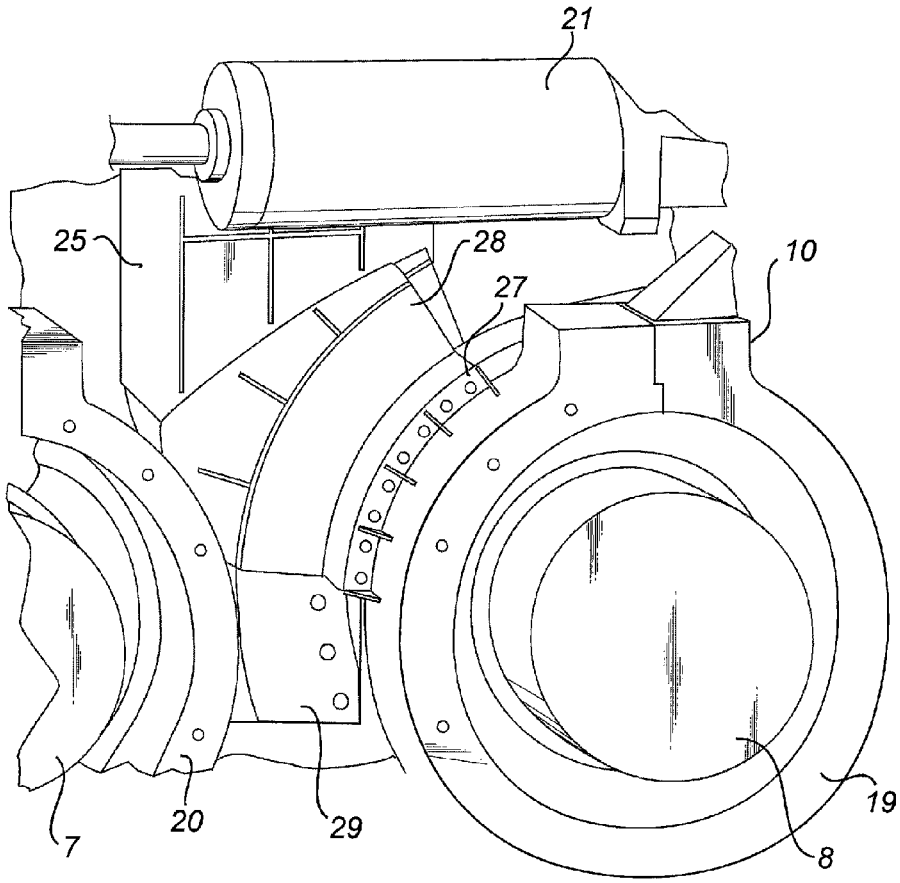
FIG. 3 shows a schematic perspective view of a detail of an embodiment of the invention.

In FIG. 3 the short ends of rollers 7, 8 can be seen positioned within bearing caps 19, 20. A bracket 27 is attached by e.g. welding to the bearing cap 19 and a cheek plate 28 is bolted to this bracket 27. Of course, other fastening means, such as welding, are conceivable to the skilled person. It would also be possible to include bracket 27 integrally in cheek plate 28. In FIG. 3, a flange 29 can be seen. This flange 29 is attached to the short side of roller 8 and has a height which is sufficient to cover the gap between the two rollers 7, 8 also when the gap is set at a use maximum. Due to the cheek plate arrangement of the present invention, the opening above the flange 29 and below the side plate 25 is covered at all times. If the position or the width of the gap is adjusted, due to e.g. wear of the rollers, the cheek plate 28 which is fixedly mounted to the bearing cap 19 and thereby also to the front roller plate 12, will follow every move of the roller frame section 10. And since the upper surface of the cheek plate 28 and the lower surface of side plate 25 have matching curvatures, as can be seen in FIGS. 2 and 3, reliable sealing is guaranteed also when the cheek plate 28 moves with roller frame section 10. Without this type of cheek plate 28, the gap over the flange 29 would be filled with material. Since the cheek plate 28 is fixedly mounted relative to the flange 29, effective sealing between towards the flange can be ensured at all time. The cheek plate 29 preferably comprises liner material on its inside. Of course, even though only the front side is shown in the figures, corresponding arrangements are found on the rear side.

Figure 4:
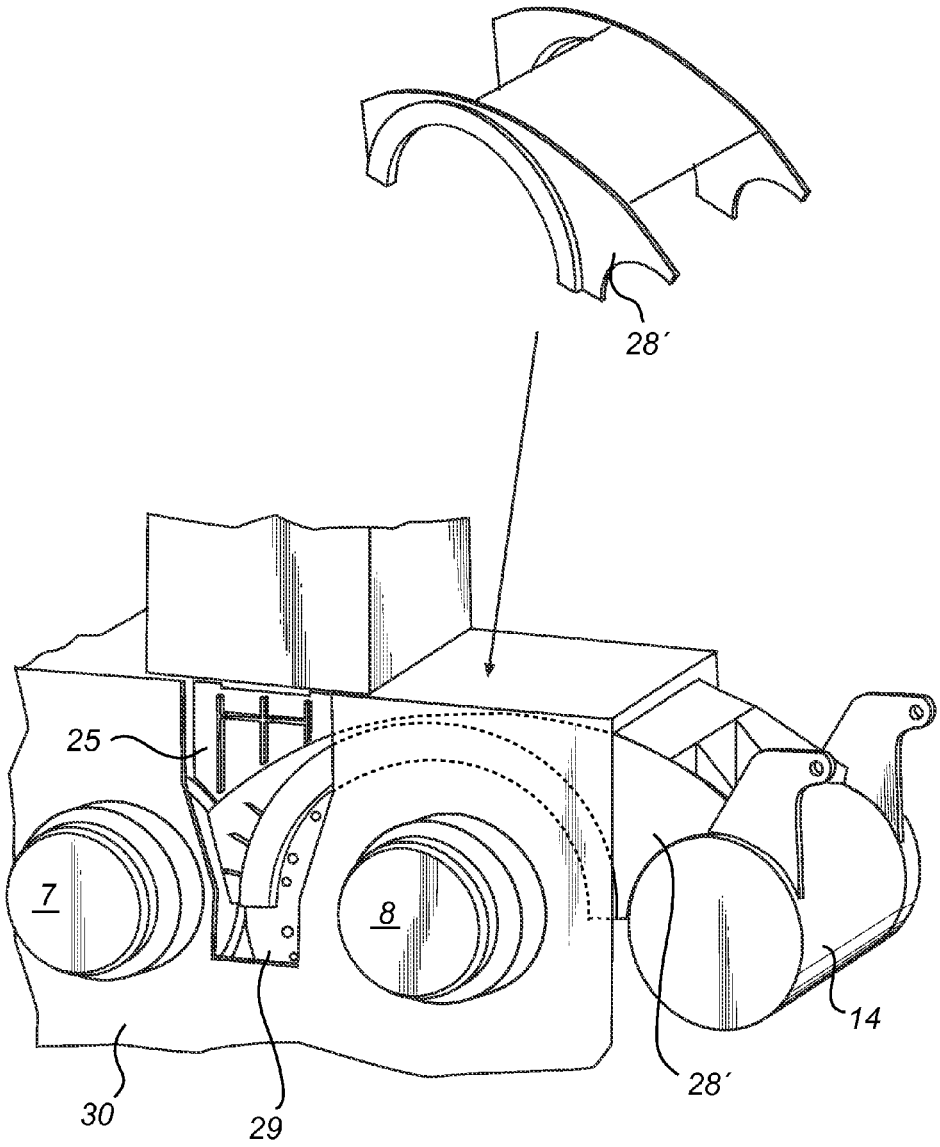
FIG. 4 shows a schematic perspective view of a detail of another embodiment of the invention.

FIG. 4 shows an alternative embodiment of the invention comprising a cheek plate 28'. In this embodiment, the cheek plate 28' is attached to the spacer pipe 14. This solution ensures even better sealing properties against the flange 29 since almost half of the periphery of flange 29 is covered by the cheek plate 28'. Similar to the cheek plate described in connection with FIG. 3, the cheek plate 28' is fixedly mounted relative the roller frame section 10 and will follow every move thereof.

When the roller crusher according to the present invention is used, material to be crushed is fed into the opening 4 of the feeding arrangement 2. The material flows through the feeding arrangement 2, passes the control gates regulating the flow, exits via the guiding plates 23, 24 and arrives at the rollers 7, 8. A sensor may be provided within the roller crusher, e.g. on one of the rollers 7, 8, for determining the position of the centre of the gap between the rollers 7, 8 relative to the feed chute 22 of the feeding arrangement 2. The sensor sends a signal to a Programmable Logic Sensor which determines if the position lies within a pre-set acceptable range. If the position of the gap lies outside of this range, the PLC will send a signal activating the adjustment cylinders which will cause the roller frame sections 9, 10 to pivot around their connection to the base frame. This pivotal movement will re-position the frame sections 9, 10 and together with them the rollers 7, 8 until the gap between the rollers 7, 8 lies within the acceptable range relative to the feed chute. The centring of the gap relative to the feed chute is of great importance to avoid uneven wear of the rollers and power consumption of the rollers. This stands in contrast to prior art crushers where the feeding arrangement is moved relative to the rollers when the feeding of material is off-centre.

Similarly, sensors will determine if the width of the gap lies within an acceptable range and if this is not the case, the PLC will activate one or both gap adjusting cylinders 21. Due to the fact that two, individually adjustable gap adjusting cylinders are provided, one at the front and one at the rear, the skew between the rollers 7, 8 can be adjusted as suitable. Hence, if an uneven load of material reaches the rollers 7, 8 this can be compensated for by means of the gap adjusting cylinders. Other parameters can also be monitored and compensated for, e.g. the pressure within the gap adjusting cylinders 21, rotational speed of the rollers, 7, 8, the flow of material through the feeding arrangement and many others which are obvious to the skilled person. By using a plurality of hydraulic pumps and a suitable number of relief valves, a high degree of independency between the different hydraulic cylinders can be obtained.

Instead of using gap adjusting cylinders 21, it would be possible within the scope of the appended claims to arrange adjustment cylinders to hooks 15, 16 provided at roller frame section 9 as well (not shown in the figures). By controlled activation of the adjustment cylinders attached to the respective roller frame sections 9, 10 it would be possible to adjust both the gap width and the gap position relative to the feed arrangement 2 without the use of gap adjustment cylinders 21. Furthermore, it is apparent that the balancing cylinders 17, 18 do not necessarily have to be attached with their upper ends to the spacer pipe 14 being outwardly inclined. Instead, they could, for example, be attached with their upper ends to an outer surface of the front and rear roller plates 12, 13 of the roller frame section being inwardly inclined. This would provide for a more compact execution of the roller crusher 1. It should also be noted that a replacement or service of the rollers 7, 8 is facilitated by the construction of the roller crusher according to the present invention. Should maintenance or even replacement of the equipment be required, the adjustment cylinders are dismounted, thereafter the respective roller frame sections are pivoted outwardly to the respective sides. The balancing cylinders may provide support during this outward pivoting. Thereafter, access is easy for e.g. replacement of rollers or similar by simply hoisting the rollers upwardly. This stands in sharp contrast to many prior art crushers where dismantling of the equipment is labour intensive and complicated.

The invention claimed is:

1. A roller crusher having a stationary base frame and a roller frame movably connected to said base frame, wherein two generally parallel rotatable rollers are arranged in said roller frame, the roller crusher further comprising:

a stationary feeding arrangement for feeding material to said rollers; and at least one balancing cylinder connected to and arranged to manipulate said roller frame relative to said base frame such that the position of the rollers can be adjusted relative to the stationary feeding arrangement, and wherein front and rear cheek plates are provided at the roller frame partially covering front and rear end surfaces of one of the rollers and at least partially covering an opening between said feeding arrangement and said two rollers, said cheek plates being fixedly mounted to the roller frame such that the cheek plates move relative to the feeding arrangement with the roller frame.

2. A roller crusher in accordance with claim 1, wherein the roller frame comprises a first and a second roller frame section, each roller frame section being pivotably connected with the base frame and arranged to carry one of said rollers in bearings arranged at opposed ends of said each roller.

3. A roller crusher in accordance with claim 2, wherein each roller frame section comprises a front and a rear roller plate, said front and rear roller plates being interconnected by means of a spacer pipe extending substantially parallel with the rollers.

4. A roller crusher in accordance with claim 3, wherein the bearings carrying each roller are mounted in a front bearing cap comprised in the front roller plate and a rear bearing cap comprised in the rear roller plate.

5. A roller crusher in accordance with claim 4, wherein the front cheek plate is fixedly mounted to the front bearing cap of the first roller frame section and the rear cheek plate is fixedly mounted to the rear bearing cap of said first roller frame section.

6. A roller crusher in accordance with claim 3, wherein the front and rear cheek plates are fixedly mounted to said spacer pipe.

7. A roller crusher in accordance with claim 1, wherein the feeding arrangement comprises a front side plate and a rear side plate, wherein a lower surface of each side plate and an upper surface of an adjacent cheek plate are arranged to be vertically opposed to each other and have corresponding arcuate shapes.

8. A roller crusher in accordance with claim 7, wherein a distance between the lower surface of each side plate and the upper surface of the adjacent cheek plate is approximately 10 mm.

9. A roller crusher in accordance with claim 7, wherein the front and rear side plates of the feeding arrangement are stationary and the front and rear cheek plates are movable with the roller frame, wherein the corresponding shapes of the lower surface of each side plate and the upper surface of an adjacent cheek plate are arranged such that, during adjustment of the roller frame to adjust the position of the rollers, the upper surface of the cheek plate remains vertically opposed to the lower surface of the adjacent side plate to ensure continued sealing.

10. A roller crusher in accordance with claim 5, wherein a bracket is welded to the front and the rear bearing cap respectively and wherein the front and the rear cheek plates are bolted to a respective bracket.

11. A roller crusher in accordance with claim 6, wherein brackets are welded to the spacer pipe and wherein the front and the rear cheek plates are bolted to a respective bracket.

12. A roller crusher in accordance with claim 3, further comprising two gap adjusting cylinders, wherein one gap adjusting cylinder interconnects the respective front roller plates of the first and second roller frame sections and another gap adjusting cylinder interconnects the respective rear roller plates of the first and second roller frame sections and wherein the gap adjusting cylinders are individually adjustable.

13. A roller crusher in accordance with claim 1, wherein two balancing cylinders arranged to extend between the roller frame and the base frame.

14. A roller crusher in accordance with claim 1, further comprising a Programmable Logic Controller (PLC) arranged to monitor and adjust operating conditions of the roller crusher.

15. A roller crusher in accordance with claim 7, wherein the corresponding shapes of the lower surface of each side plate and the upper surface of an adjacent cheek plate are arcuate shaped and match the motion pattern of the roller frame section during adjustment of the position of the rollers.

16. A roll crusher having two generally parallel rotatable rollers separated by a crushing gap and a feeding arrangement for feeding material to the crushing gap between the rollers, the roll crusher further comprising:

a stationary base frame;

a first roller frame pivotally connected to the base frame and arranged for carrying one of the rollers;

a second roller frame pivotally connected to the base frame and arranged for carrying one of the rollers;

a stationary feeding arrangement including first and second side plates each having an arcuate lower surface;

front and rear cheek plates mounted to one of the roller frames for partially covering front and rear end surfaces of one of the rollers and at least partially covering an opening between the front and rear side plates of the feeding arrangement and the two rollers, wherein the cheek plates each include an arcuate upper surface located vertically opposed to the arcuate lower surface of the front and rear side plates such that the upper surface of the cheek plates and the lower surface of the front and rear side plates remain vertically opposed during movement of the roller frames; and at least one balancing cylinder connected to and arranged to manipulate the roller frames relative to the base frame such that the position of the rollers can be adjusted relative to the stationary feeding arrangement.

17. A roller crusher in accordance with claim 1, wherein the feeding arrangement comprises a front side plate and a rear side plate, wherein a lower surface of each side plate and an upper surface of an adjacent cheek plate are arranged to be vertically opposed to each other and have corresponding shapes.

18. A roller crusher in accordance with claim 17, wherein a distance between the lower surface of each side plate and the upper surface of the adjacent cheek plate is approximately 10 mm.

19. A roller crusher in accordance with claim 17, wherein the front and rear side plates of the feeding arrangement are stationary and the front and rear cheek plates are movable with the roller frame, wherein the corresponding shapes of the lower surface of each side plate and the upper surface of an adjacent cheek plate are arranged such that, during adjustment of the roller frame to adjust the position of the rollers, the upper surface of the cheek plate remains vertically opposed to the lower surface of the adjacent side plate to ensure continued sealing.

* * * * *